US011125412B2

(12) United States Patent
Dubuc et al.

(10) Patent No.: US 11,125,412 B2
(45) Date of Patent: Sep. 21, 2021

(54) LIGHTING DEVICE WITH EFFICIENT LIGHT-SPREADING LENS SYSTEM

(71) Applicant: Current Lighting Solutions, LLC, East Cleveland, OH (US)

(72) Inventors: Eden Dubuc, Lachine (CA); Brian Morgan Spahnie, East Cleveland, OH (US)

(73) Assignee: CURRENT LIGHTING SOLUTIONS, LLC, East Cleveland, OH (US)

( * ) Notice: Subject to any disclaimer, the term of this patent is extended or adjusted under 35 U.S.C. 154(b) by 0 days.

(21) Appl. No.: 14/697,691

(22) Filed: Apr. 28, 2015

(65) Prior Publication Data

US 2016/0153705 A1 Jun. 2, 2016

Related U.S. Application Data

(60) Provisional application No. 62/086,063, filed on Dec. 1, 2014.

(51) Int. Cl.
*F21V 5/00* (2018.01)
*F25D 27/00* (2006.01)
(Continued)

(52) U.S. Cl.
CPC ..... *F21V 5/007* (2013.01); *A47F 3/001* (2013.01); *A47F 3/0404* (2013.01); *F21V 5/046* (2013.01);
(Continued)

(58) Field of Classification Search
CPC ..... F25D 27/00; F25D 23/065; F25D 23/028; F25D 25/02; A47F 3/001; A47F 3/04;
(Continued)

(56) References Cited

U.S. PATENT DOCUMENTS

D126,993 S * 5/1941 Trautner ..... D26/124
7,118,262 B2 * 10/2006 Negley ..... H01L 33/58 362/555
(Continued)

FOREIGN PATENT DOCUMENTS

CN 101078494 A 11/2007
CN 103574466 A 2/2014
(Continued)

OTHER PUBLICATIONS

European Search Report and Opinion issued in connection with corresponding EP Application No. 15195598.6 dated Feb. 19, 2016.
(Continued)

*Primary Examiner* — Daniel J Troy
*Assistant Examiner* — Timothy M Ayres
(74) *Attorney, Agent, or Firm* — Buckley, Maschoff & Talwalkar LLC

(57) ABSTRACT

A lighting device includes a light emitting diode (LED) that has a main axis of light emission. The lighting device also includes a lens element positioned adjacent the LED. The lens element has a geometry defined by at least partial revolution of a cross-sectional profile around an axis of revolution. The lens element is positioned relative to the LED such that the axis of revolution crosses the main axis of light emission of the LED. The lens element is operative to apply total internal reflection to at least some light rays emitted from the LED.

5 Claims, 6 Drawing Sheets

(51) Int. Cl.

| | |
|---|---|
| ***F21V 33/00*** | (2006.01) |
| ***F25D 23/06*** | (2006.01) |
| ***F25D 23/02*** | (2006.01) |
| ***F25D 25/02*** | (2006.01) |
| ***F21V 7/00*** | (2006.01) |
| ***A47F 3/00*** | (2006.01) |
| ***A47F 3/04*** | (2006.01) |
| ***F21V 5/04*** | (2006.01) |
| *F21W 131/305* | (2006.01) |
| *F21W 131/403* | (2006.01) |
| *F21Y 115/10* | (2016.01) |
| *F21S 4/20* | (2016.01) |
| *F21Y 103/10* | (2016.01) |
| *F21V 13/04* | (2006.01) |

(52) U.S. Cl.
CPC ..... *F21V 7/0091* (2013.01); *F21V 33/0044* (2013.01); *F25D 23/028* (2013.01); *F25D 23/065* (2013.01); *F25D 25/02* (2013.01); *F25D 27/00* (2013.01); *F21S 4/20* (2016.01); *F21V 13/04* (2013.01); *F21W 2131/305* (2013.01); *F21W 2131/403* (2013.01); *F21Y 2103/10* (2016.08); *F21Y 2115/10* (2016.08)

(58) Field of Classification Search
CPC ..... F21V 5/007; F21V 5/046; F21V 33/0044; F21V 7/0091; F21V 13/04; F21S 4/20; F21W 2131/305; F21W 2131/403; F21Y 2101/02; F21Y 2103/003; F21Y 2105/001
See application file for complete search history.

(56) References Cited

U.S. PATENT DOCUMENTS

| | | | | |
|---|---|---|---|---|
| 7,300,185 | B1 | 11/2007 | Ruffin et al. | |
| 7,712,931 | B1 | 5/2010 | Smith | |
| 7,762,692 | B2 * | 7/2010 | Lai | G02B 6/0021 257/100 |
| 7,809,237 | B2 * | 10/2010 | Pozdnyakov | H01L 33/58 385/146 |
| 7,926,977 | B2 | 4/2011 | Nall et al. | |
| 8,002,434 | B2 * | 8/2011 | Sommers | A47F 3/001 362/241 |
| 8,888,338 | B2 * | 11/2014 | Sun | F21V 13/04 362/311.02 |
| 9,239,144 | B2 | 1/2016 | Zwick et al. | |
| 9,638,852 | B2 * | 5/2017 | Sakai | G02B 6/0011 |
| 2002/0080615 | A1 * | 6/2002 | Marshall | G02B 3/00 362/333 |
| 2005/0286251 | A1 * | 12/2005 | Smith | F21S 4/28 362/327 |
| 2006/0034097 | A1 * | 2/2006 | Hahm | H01L 33/58 362/555 |
| 2007/0195535 | A1 * | 8/2007 | Artwohl | A47F 3/001 362/341 |
| 2008/0186695 | A1 | 8/2008 | Awai et al. | |
| 2008/0219002 | A1 | 9/2008 | Sommers et al. | |
| 2009/0103325 | A1 | 4/2009 | Dubuc | |
| 2010/0073937 | A1 * | 3/2010 | Ho | F21V 5/04 362/335 |
| 2010/0097780 | A1 * | 4/2010 | Beatenbough | A47F 3/001 362/92 |
| 2010/0214769 | A1 * | 8/2010 | Bhargava | A47F 3/001 362/125 |
| 2011/0019400 | A1 * | 1/2011 | Huang | F21V 5/04 362/235 |
| 2011/0051401 | A1 | 3/2011 | Bauer et al. | |
| 2011/0058357 | A1 * | 3/2011 | Anderson | A47F 3/001 362/125 |
| 2011/0096533 | A1 | 4/2011 | Sekela et al. | |
| 2014/0049955 | A1 | 2/2014 | Chen et al. | |
| 2014/0063802 | A1 * | 3/2014 | Garcia | F21V 5/007 362/241 |
| 2014/0078732 | A1 | 3/2014 | Smith | |
| 2014/0218909 | A1 | 8/2014 | Tetsuo et al. | |

FOREIGN PATENT DOCUMENTS

| | | | |
|---|---|---|---|
| TW | 200607124 | A | 2/2006 |
| WO | 2007090292 | A1 | 8/2007 |
| WO | 2014063447 | A1 | 5/2014 |
| WO | 2014113766 | A1 | 7/2014 |

OTHER PUBLICATIONS

Office Action issued in connection with corresponding MX Application No. MX/A/2015/016499 dated Jul. 25, 2017.
Office Action Issued in connection with corresponding Chinese Application No. 201510866422.1 dated May 12, 2020.

* cited by examiner

LIGHTING DEVICE WITH EFFICIENT LIGHT-SPREADING LENS SYSTEM

CROSS REFERENCE TO RELATED APPLICATION

This application claims the benefit of prior-filed, commonly-owned, copending U.S. provisional patent application Ser. No. 62/086,063, filed Dec. 1, 2014, which is hereby incorporated by reference in its entirety as if set forth fully herein.

BACKGROUND

Embodiments of the invention relate to lighting devices.

Large refrigeration units present particular challenges in providing suitable lighting of the contents of shelves within the units. LED (light-emitting diode) based lighting systems have been proposed.

FIG. 1 is an isometric view of a portion of a conventional lens element 100 for a lighting device for a refrigerator. It will be noted that the lens element is elongate, with a uniform cross-sectional profile for sections taken along the length dimension of the lens element. In an actual installation, a series of LEDs would be positioned within a slot 102 at the base 104 of the lens element 100.

FIG. 2 is a sectional view of such a conventional lighting device, utilizing the lens element 100. The section for the view of FIG. 2 is taken in a plane perpendicular to the length dimension of the lens element 100. An LED 200 is shown positioned in the above-mentioned slot 102 of the lens element 100. Ray tracing lines 202, 204, 206, 208 and 210 are shown in the drawing. These are only a few of numerous ray-tracings that could be presented to show light-spreading effects of the lens element 100. For example, all of the ray tracings shown in FIG. 2 exit the lens element 100 to the leftward direction of the drawing. Similar ray tracings could also be drawn exiting the lens element 100 in the righward direction, but are omitted to simplify the drawing.

Part of the light-spreading characteristic of the lens element 100 is due to refraction of rays 202, 204, 206. However, as to rays, 208, 210, the same are first subjected to internal reflection (at points 212, 214, respectively) before being refracted and exiting the lens element 100 in the leftward direction.

The present inventors have now recognized opportunities to provide lensing for a lighting fixture that spreads light more uniformly and efficiently than conventional lensing systems.

BRIEF DESCRIPTION

In some embodiments, a lighting device includes an LED having a main axis of light emission. The lighting device further includes a lens element positioned adjacent the LED. The lens element has a geometry defined by at least a partial revolution of a cross-sectional profile around an axis of revolution. The lens element is positioned relative to the LED such that the axis of revolution crosses the main axis of light emission of the LED. The lens element is operative to apply total internal reflection to at least some light rays emitted from the LED.

DESCRIPTION

Some embodiments relate to lighting devices in which individual lens elements are provided for each LED in a lighting device. The lens elements have a revolved geometry that applies total internal reflection (TIR) to some light rays from the LEDs and improves the efficiency of light spreading relative to the LEDs. The lighting devices may be suitable for use in refrigeration units, and may provide improved efficiency in comparison with conventional lighting devices.

Figure 3:
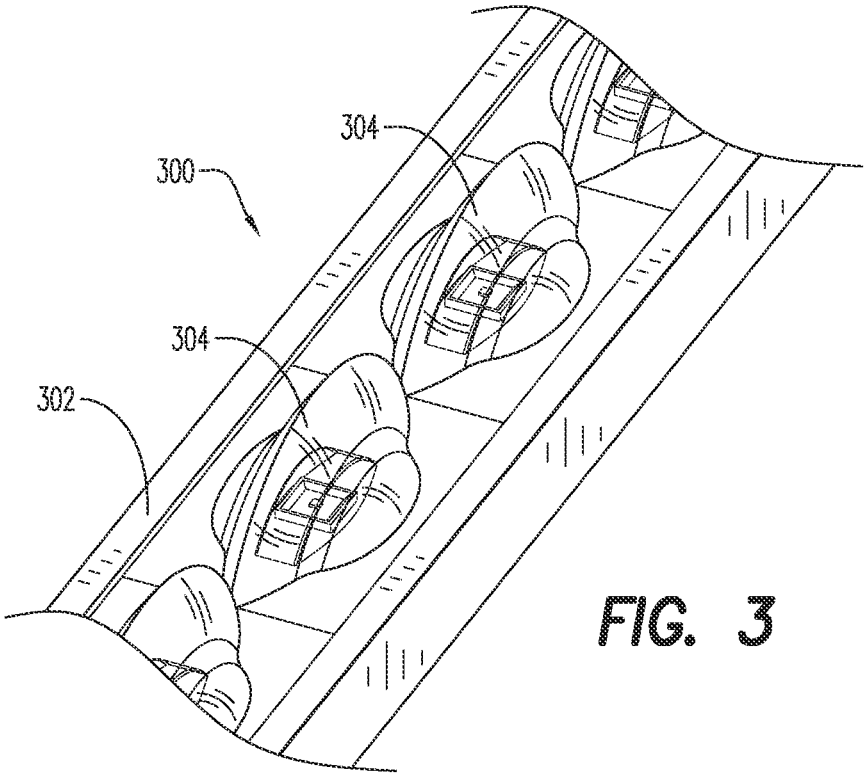
FIG. 3 is a partial perspective view of a lighting device according to some embodiments.

FIG. 3 is a partial perspective view of a lighting device 300 according to some embodiments. The lighting device 300 includes an elongate support member 302, of which only a portion is visible in the drawing. The lighting device 300 also includes a number of lens elements 304 mounted on, and along the length of, the support member 302. Only two of the lens elements 304 are visible in FIG. 3. All of the lens elements of the lighting device 300 may be substantially identical to each other.

Figure 4:
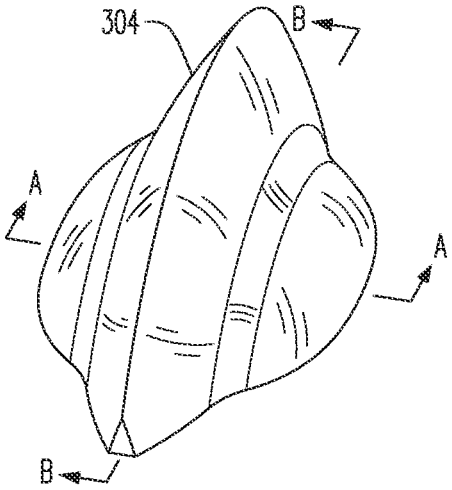
FIG. 4 is an isometric view of a lens element included in the lighting device of FIG. 3.

FIG. 4 is an isometric view of one of the lens elements 304 seen in FIG. 3. The lens element 304 may, for example, be formed of a clear plastic such as polycarbonate or acrylic. The lens element 304 may, for example, be formed by an injection molding process.

Figure 5:
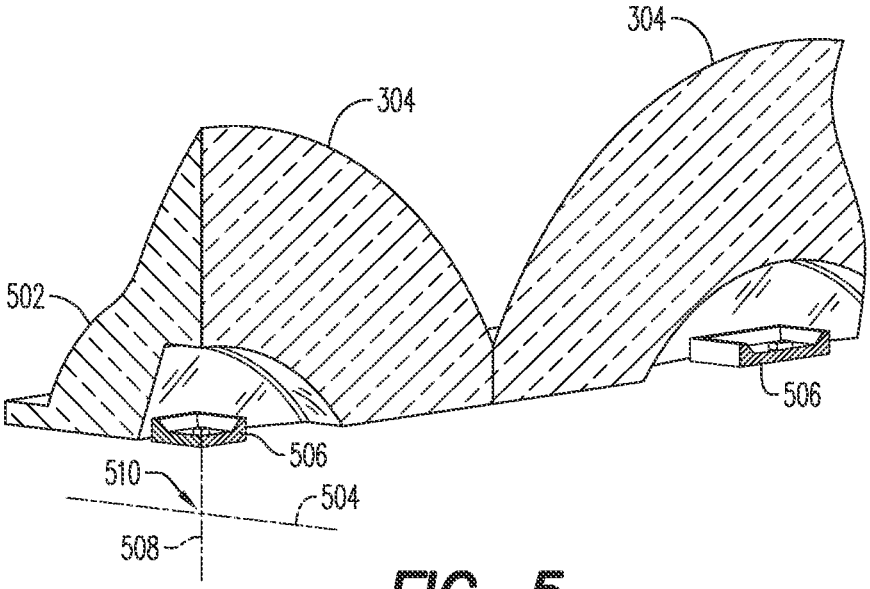
FIG. 5 is a cut-away view of a portion of the lighting device of FIG. 3.

FIG. 5 is a cut-away view of a portion of the lighting device 300. The view of FIG. 5 is cut away at two planes that are perpendicular to each other. One of the planes is indicated by line A-A in FIG. 4. The latter plane shows a cross-sectional profile 502. The geometry of the lens element 304, as best comprehended from FIGS. 4 and 5, is defined by revolving the cross-sectional profile 502 around an axis of rotation labeled with reference numeral 504 in FIG. 5. (Only half of the cross-sectional profile in question is indicated at 502 in FIG. 5; the entire cross-sectional profile will be indicated in a subsequent drawing, i.e., in FIG. 8.) The second plane of cutting away for the view of FIG. 5 is indicated by line B-B in FIG. 4. It should be understood that the terminology of defining a geometry by revolution of a cross-sectional profile around an axis of revolution is akin conceptually to forming the three dimensional figure of a torus by revolving a circle around an axis of revolution spaced from the circle and in the plane of the circle. In the case of the lens elements 304, the degree of revolution of the cross-sectional profile is partial; for example, it is 180 degrees in this example embodiment.

Referring again to FIG. 5, LEDs 506 are also shown in the drawing. The LEDs 506 are also included in the lighting device 300 seen in FIG. 3 (the LEDs are not visible in FIG. 3). Continuing to refer to FIG. 5, each LED 506 is adjacent to and substantially surrounded by a respective one of the lens elements 304. Continuing to refer to FIG. 5, the LED 506 at the left of the drawing is shown as having a main axis of light emission 508. (Each other LED 506 in the lighting device 300 may have a similarly oriented main axis of light emission.) As seen at 510 in FIG. 5, the main axis of light emission 508 of the associated LED 506 intersects—and indeed may be perpendicular to—the axis of rotation 504 that defines the geometry of the associated lens element 304. Also, each LED 506 is located within the footprint of its associated lens element 304. Such is the positioning of each lens element 304 and its associated LED 506 relative to each other in some embodiments.

The point indicated at 510 in FIG. 5 may be referred to as a point of intersection between the main axis of light emission 508 and the axis of revolution 504, both of which are discussed above. In some embodiments the LED 506 may be located at or above the point of intersection 510. In other embodiments the LED 506 may be located below the point of intersection 510.

Referring to FIGS. 3 and 5, the surface of the support member 302 on which the LEDs 506 and lens elements 304 are mounted may be considered the "main surface" of the support member 302. It will be recognized from FIG. 5 that the axes of revolution (e.g., axis 504) for the lens elements 304 are oriented parallel to the main surface of the support member 302 and perpendicular to the length dimension of the support member 504.

Figure 6:
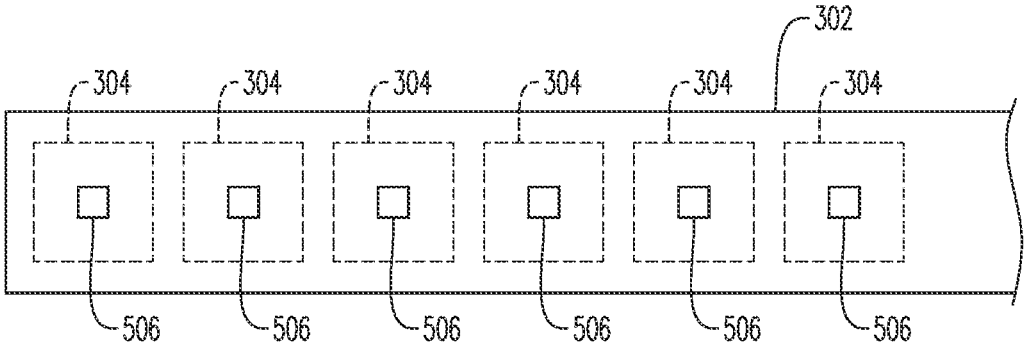
FIG. 6 is a schematic plan view of a portion of the lighting device of FIG. 3.

FIG. 6 is a schematic plan view of a portion of the lighting device 300. Again the elongate support member 302 is partially seen, along with a group of six LEDs 506 located along the length dimension of the support member 302. Each LED 506 is shown positioned in the footprint of an associated lens element 304. (The lens elements 304 are schematically represented in FIG. 6 by dashed-line squares; a more realistic illustration of the lens elements' shape is seen, for example, in FIG. 4.) Returning to FIG. 6, in some embodiments, one or more additional groups of six LEDs with associated lens elements may be located along the support member 302 at portions thereof that are not visible in the drawing. Other groups or groupings of other numbers of LEDs may be used in other embodiments.

Figure 7:
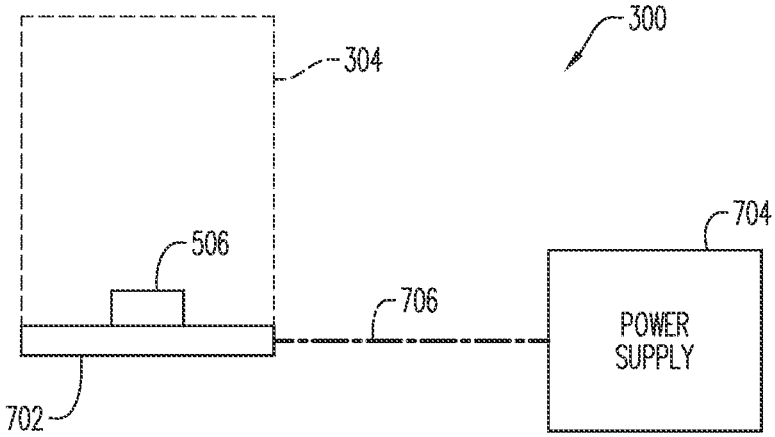
FIG. 7 is a block diagram representation of aspects of the lighting device of FIG. 3.

FIG. 7 is a block diagram representation of aspects of the lighting device 300. A typical one of the LEDs 506 is shown mounted on a circuit board 702, which is also part of the lighting device 300. (The circuit board 702 may be supported by the support member referred to above, which is not shown in FIG. 7.) The lens element 304 associated with the LED 506 is again schematically indicated by dashed lines. The lighting device may be connected to a power supply 704 via the circuit board 702 and wiring 706.

Referring again to FIG. 8, the cross-sectional profile 502 of the lens element 304 is shown as being symmetrical in this embodiment relative to the axis 508. In other embodiments, however, the configuration of the cross-sectional profile may be asymmetrical. For example, in some embodiments, the configuration of the cross-sectional profile may be such that, for example, most or all of the light from the LED 506 is directed to the left or right, as viewed in FIG. 8.

Referring again to FIG. 8, the cross-sectional profile 502 of the lens element 304 is shown as being symmetrical in this embodiment relative to the axis 508. In other embodiments, however, the configuration of the cross-sectional profile may be asymmetrical. For example, in some embodiments, the configuration of the cross-sectional profile may be such that, for example, most or all of the light from the LED 506 is directed to the left or right, as view in FIG. 8.

Figure 8:
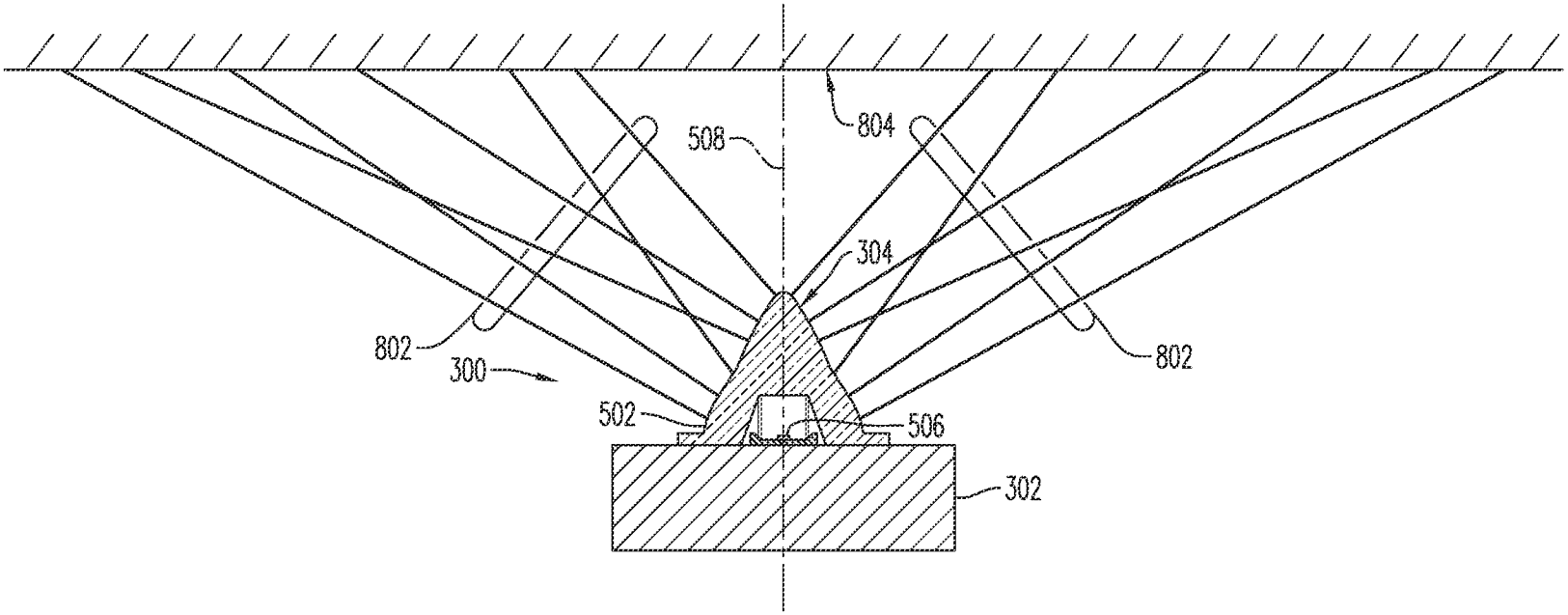
FIG. 8 is a sectional view of the lighting device of FIG. 3.

FIG. 8 shows light rays 802 illuminating a front surface 804 of an object (not illustrated apart from front surface 804) on a shelf (not shown in FIG. 8) in a refrigerator enclosure (not specifically shown in FIG. 8). The exact dimensions and configuration of the cross-sectional profile 502 may vary depending on the geometry of the refrigeration enclosure/shelving to be illuminated; the dimensions and configuration that are suitable for a particular application may be determined without undue experimentation based on the disclosure contained herein.

Figure 9:
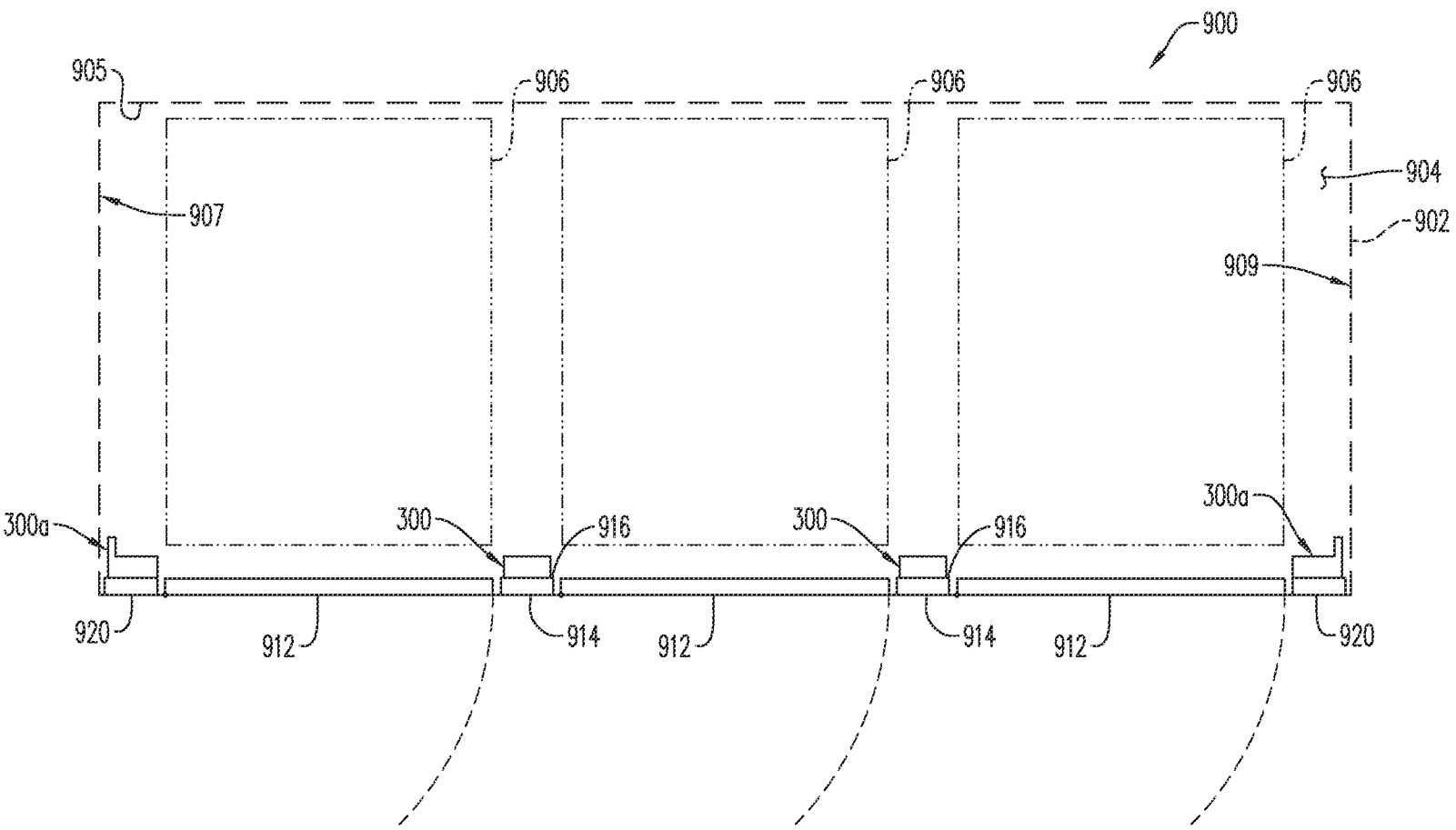
FIG. 9 is a schematic plan view of a refrigerator that incorporates, in accordance with some embodiments, lighting devices such as the lighting device of FIG. 3.

FIG. 9 is a schematic plan view of a refrigerator 900, in accordance with some embodiments. The refrigerator includes an enclosure 902, which defines an enclosed, refrigerated space 904. (Cooling elements of the refrigerator 900, though present, are not shown.) The enclosure 902 includes a rear wall 905 and side walls 907 and 909.

The refrigerator 900 also includes shelves 906 in the refrigerated space 904. The shelves 906 are for holding items (not shown) to be refrigerated.

The enclosure 902 also includes doors 912 for permitting access to the shelves 906. Vertically extending mullions 914 are interspersed among the doors. Each of the mullions has an interior surface 916 that faces inwardly relative to the enclosed refrigerated space 904. The interior surface 916 of each mullion 914 has a lighting device 300 (as described above) installed thereon in a vertical orientation.

The refrigerator 900 also includes corner mullions 920 that vertically extend adjacent the front edges of the side walls 907, 909. (That is, each corner mullion 920 is located at a front corner of the refrigerator 900.) Each of the mullions 920 has a lighting device **300*a*** installed on an interior surface thereof in a vertical orientation.

Figure 10:
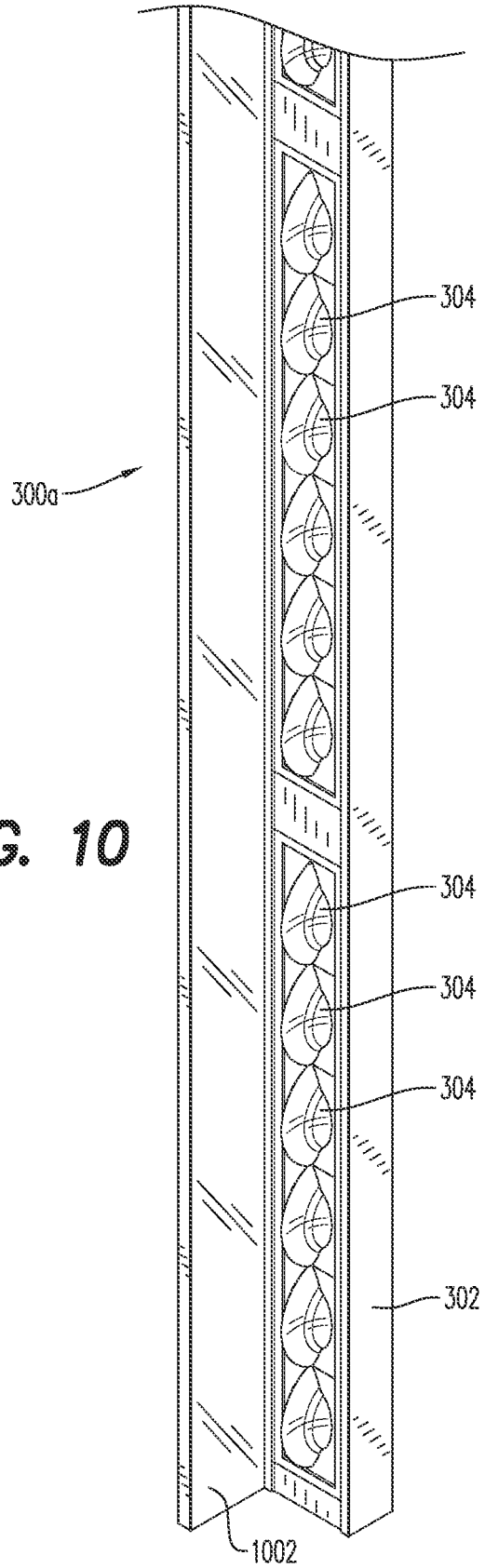
FIG. 10 is a perspective view of a portion of another embodiment of the lighting device of FIG. 3.

FIG. 10 is a partial perspective view of one of the lighting devices **300*a*, which is an alternative embodiment of the above-described lighting device 300. The lighting device 300*a* may include all of the above-described elements of the lighting device 300. In addition, the lighting device 300*a* includes a mirror 1002 mounted on the support member 302. The mirror 1002 may be oriented perpendicular to the plane of the support member 302, and may extend along at least a portion of the length dimension of the support member 302. The reflecting side of the mirror 1002 may face towards the LEDs (not visible in FIG. 10) and towards the associated lens elements 304 mounted on the support member 302. The lighting devices 300*a* may be installed on the corner mullions 920 such that the reflecting sides of their mirrors face away from the adjacent side walls of the refrigerator 900. Thus the mirrors may reflect rays from the LEDs towards the shelves 906**.

Figure 1:
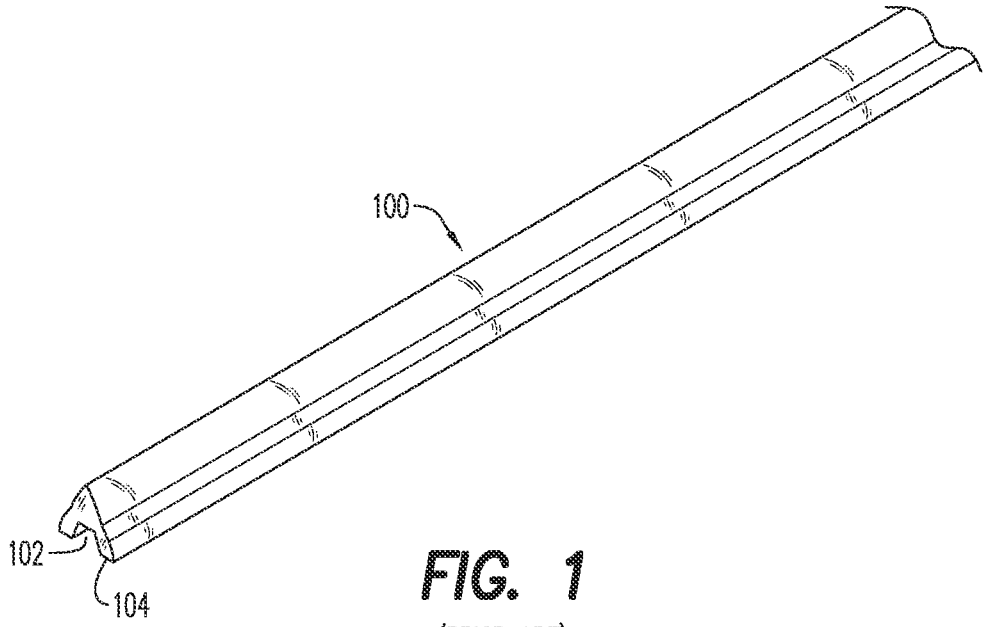
FIG. 1 (PRIOR ART)
FIG. 1 is an isometric view of a portion of a conventional lens element for a lighting device.
Figure 2:
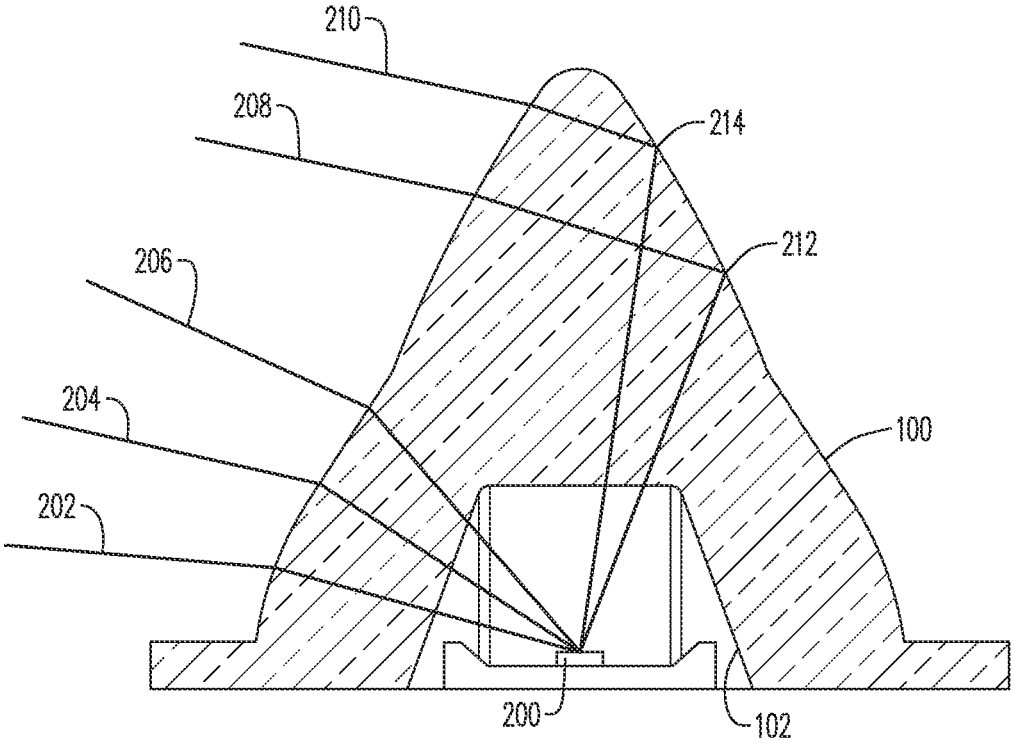
FIG. 2 (PRIOR ART)
FIG. 2 is a sectional view of a lighting device like the device referred to above in connection with FIG. 1.

A lighting device with a lensing arrangement as in embodiments described herein may provide a more efficient and uniform distribution of light to illuminate objects within a refrigerator. Savings in energy may result. Moreover, the lensing arrangement of embodiments described herein may use less material than a conventional lens such as that shown in FIG. 1, and may be easier to seal than a conventional lens. Moreover, the lensing arrangement of embodiments described herein may produce less color separation than a conventional lens.

The lens element 304, and/or the lighting device 300 that has such lens elements arranged in a row accompanying a series of LEDs, has been described primarily for application to lighting a refrigerator. However, other applications are possible, including use in a shallow box sign or other signage applications, or for under-shelf lighting, or as a cornice lighting device, or as a so-called "wall washer" (i.e., a lighting device that bathes a wall with light rather than primarily illuminating a limited zone or spot on a wall).

A technical effect is to provide improved efficiency in lighting the interiors of refrigerators and in other lighting applications.

Embodiments described herein are solely for the purpose of illustration. A person of ordinary skill in the relevant art may recognize other embodiments may be practiced with modifications and alterations to that described above.

What is claimed is:

1. A lighting device, comprising:

a light emitting diode (LED) having a main axis of light emission; and a lens element positioned adjacent the LED, the lens element having a geometry defined by at least partial revolution of a cross-sectional profile around an axis of revolution;

the lens element positioned relative to the LED such that said axis of revolution crosses the main axis of light emission of the LED at a point which is below the LED, the lens element operative to refract at least some light rays emitted from the LED without having been reflected, and operative to refract at least some rays emitted by the LED after having been internally reflected by the lens element;

said geometry configured such that light from said LED is directed to regions to sides of the main axis of light emission;

said lens element forming a peak at a location on said main axis of light emission.

2. The lighting device of claim 1, wherein said axis of revolution is perpendicular to the main axis of light emission of the LED.

3. The lighting device of claim 1, further comprising: an elongate support member on which the LED and the lens element are mounted.

4. The lighting device of claim 1, wherein:

the LED is a first LED; and the lens element is a first lens element;

the lighting device further comprising:

a plurality of lens elements mounted on the elongate support member in addition to the first lens element, all of said lens elements substantially identical to each other; and a plurality of LEDs mounted on the elongate support member in addition to the first LED, each of said plurality of LEDs located within a footprint of a respective one of the plurality of lens elements.

5. The lighting device of claim 1, wherein the lens element is formed such that its said geometry is defined by a substantially 180° revolution of said cross- sectional profile around said axis of revolution.

* * * * *